US011094248B2

(12) United States Patent
Hsiao

(10) Patent No.: US 11,094,248 B2
(45) Date of Patent: Aug. 17, 2021

(54) LED DRIVING APPARATUS FOR DRIVING AN LED ARRAY

(71) Applicant: Novatek Microelectronics Corp., Hsinchu (TW)

(72) Inventor: Sheng-Wen Hsiao, Changhua County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/824,712

(22) Filed: Mar. 20, 2020

(65) Prior Publication Data

US 2020/0302857 A1 Sep. 24, 2020

Related U.S. Application Data

(60) Provisional application No. 62/822,017, filed on Mar. 21, 2019.

(51) Int. Cl.
*G09G 3/20* (2006.01)
*G09G 3/32* (2016.01)

(52) U.S. Cl.
CPC ..... *G09G 3/32* (2013.01); *G09G 2300/0857* (2013.01); *G09G 2310/027* (2013.01)

(58) Field of Classification Search
CPC ..... G09G 2310/027; G09G 2330/021; G09G 2310/0272; G09G 2310/0291; G09G 2320/0233; G09G 2320/064; G09G 3/3291; G09G 2310/0286; G09G 3/2011; G09G 3/3233; G09G 2310/0289; G09G 2320/045; G09G 2320/0626; G09G 2320/0633;

(Continued)

(56) References Cited

U.S. PATENT DOCUMENTS 7,224,303 B2 * 5/2007 Kwon ..... G09G 3/3241 341/144
7,348,945 B2 3/2008 Sun
2006/0132420 A1 6/2006 Yoshida et al.

(Continued)

FOREIGN PATENT DOCUMENTS

TW 200625825 7/2006

OTHER PUBLICATIONS

"Office Action of Taiwan Counterpart Application", dated Apr. 28, 2021, p. 1-p. 8.

*Primary Examiner* — Duc Q Dinh
(74) *Attorney, Agent, or Firm* — JCIPRNET

(57) ABSTRACT

An LED driving apparatus for driving an LED array including an output terminal group and a converter group is provided. The output terminal group includes a plurality of output terminals. The converter group includes a plurality of digital-to-analog converters. Each of the digital-to-analog converters outputs a driving current according to pixel data to drive a corresponding one of the LEDs. Each of digital-to-analog converters includes a plurality of sub-driving current generating circuits. The sub-driving current generating circuits are coupled to the corresponding output terminal of the output terminal group. Each of the sub-driving current generating circuits generates a sub-driving current having a current value corresponding to a bit order of a bit of the pixel data. The driving current is generated by summing up the sub-driving currents.

12 Claims, 9 Drawing Sheets

(58) Field of Classification Search
CPC .. G09G 3/2074; G09G 3/3258; G09G 3/3283;
G09G 2300/0828; G09G 3/2018
See application file for complete search history.

(56) References Cited

U.S. PATENT DOCUMENTS

| | | | | |
|---|---|---|---|---|
| 2006/0145984 | A1 | 7/2006 | Sun | |
| 2010/0141493 | A1* | 6/2010 | Cho | G09G 3/20 341/122 |

* cited by examiner

LED DRIVING APPARATUS FOR DRIVING AN LED ARRAY

CROSS-REFERENCE TO RELATED APPLICATION

This application claims the priority benefit of U.S. provisional application Ser. No. 62/822,017, filed on Mar. 21, 2019. The entirety of the above-mentioned patent application is hereby incorporated by reference herein and made a part of this specification.

BACKGROUND

Technical Field

The invention relates to a driving apparatus, more specifically, to a light emitting diode (LED) driving apparatus for driving an LED array.

Description of Related Art

The light emitting diode (micro-LED) array is generally driven by current drivers in one-to-one configuration. That is to say, each micro-LED in the array is driven by a current of the corresponding current driver. A conventional digital gray level modulation scheme for driving the micro-LED array acquires the emission luminance corresponding to a desired gray level in a horizontal line period by timing modulation, whatever the scheme is based on PWM or comparison. Such scheme has to consider and compromise between the minimum time unit and luminance steps, and the micro-LED driving circuit and associated control circuit need to be designed by the minimum time unit. However, for the analog driving circuit, time to reach the steady state needs to be shorter than the minimum time unit to avoid influence to the display quality.

SUMMARY

The invention is directed to an LED driving apparatus, capable of reducing the requirement that time to reach the steady state must be shorter than the minimum time unit, such that the display quality of the LED array driven by the LED driving apparatus is good.

An embodiment of the invention provides an LED driving apparatus for driving an LED array including an output terminal group and a converter group. The output terminal group includes a plurality of output terminals. The output terminal group is configured to be coupled to a plurality of LEDs in a row of an LED array. The converter group includes a plurality of digital-to-analog converters. Each of the digital-to-analog converters is electrically coupled to a corresponding output terminal of the output terminal group. Each of the digital-to-analog converters is configured to output a driving current according to n-bits pixel data to drive a corresponding one of the LEDs, where n is an integer greater than zero. Each of digital-to-analog converters includes n sub-driving current generating circuits. The n sub-driving current generating circuits are coupled to the corresponding output terminal of the output terminal group. Each of the n sub-driving current generating circuits is configured to generate a sub-driving current having a current value corresponding to a bit order of a bit of the n-bits pixel data. The driving current is generated by summing up n sub-driving currents.

In an embodiment of the invention, each of the digital-to-analog converters further includes a power rail and a common rail. The common rail is coupled to a corresponding output terminal of the output terminal group. The n sub-driving current generating circuits are coupled between the power rail and the common rail. The common rails of the plurality of digital-to-analog converters are separate.

In an embodiment of the invention, each of the sub-driving current generating circuits includes a switching device and a current source device. The switching device is electrically coupled to the power rail. The current source device is electrically coupled between the switching device and the common rail. The current source device is configured to generate the sub-driving current.

In an embodiment of the invention, the current source device is a current source transistor. The current source devices of the digital-to-analog converter are respectively controlled by n bias voltages so as to output the n sub-driving currents corresponding to different bit orders.

In an embodiment of the invention, an $i^{th}$ current source device is configured to provide a current having a value of $2^{(i-1)}I$, where i is an integer greater than and equal to 1 and smaller than n, and I is a current step.

In an embodiment of the invention, the switching devices is configured to output or not to output the sub-driving current to the common rail.

In an embodiment of the invention, each of the digital-to-analog converters of the converter group is configured to time-divisionally output a plurality of driving currents to sequentially drive a plurality of LEDs in a column of the LED array.

In an embodiment of the invention, the LED driving apparatus further includes a plurality of switches. Each of the plurality of switches is configured to electrically connect an LED of the LED array to a corresponding digital-to-analog converter of the converter group.

In an embodiment of the invention, each output terminal of the output terminal group is configured to be coupled through a common line to a plurality of first switches which are respectively coupled to a plurality of LEDs in a column of the LED array. The plurality of first switches are separate from the LED driving apparatus.

In an embodiment of the invention, the LED driving apparatus further includes a plurality of second switches. Each of the plurality of second switches is configured to electrically connect an output terminal of the output terminal group to a corresponding digital-to-analog converter of the converter group.

In an embodiment of the invention, the LED driving apparatus further includes a plurality of data latch circuits respectively coupled to the plurality of digital-to-analog converters of the converter group. Each of the plurality of data latch circuits is configured to store the n-bits pixel data for controlling a corresponding digital-to-analog converter of the converter group.

In an embodiment of the invention, the switching device has a low operating voltage, and the current source device has a middle operating voltage.

To make the aforementioned more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
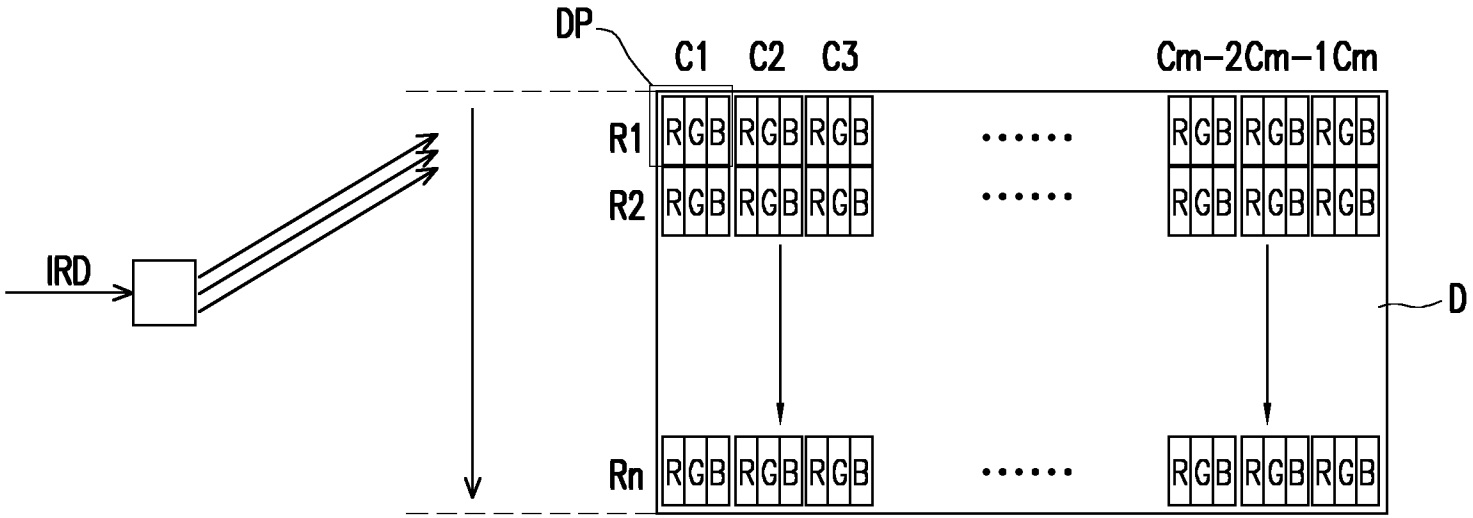
FIG. 1 is a schematic view showing a row scanning process for driving a display panel according to one embodiment of the invention.

FIG. 1 is a schematic view showing a row scanning process for driving a display panel according to one embodiment of the invention. As shown in FIG. 1, a display panel D has a display area formed of an array of digital pixels DP. To be more specific, the display area of the display panel D has m columns C1 to Cm and n rows R1 to Rn of digital pixels DP, and m and n are integers greater than or equal to 1. Each of the digital pixels DP is constituted of one blue micro-LED, one green micro-LED, and one red micro-LED and the corresponding current drivers. In addition, each of the blue micro-LED, the green micro-LED, and the red micro-LED functions as an light source when receiving data from a controller (not shown). In the display panel D, an input row data IRD is provided to a single row of the digital pixels DP or to a plurality of rows of the digital pixels DP at a time. When receiving the input row data IRD, the blue micro-LEDs, the green micro-LEDs, and the red micro-LEDs in the single row or the plurality of rows emit blue light, green light, and red light so as to function as the light source at that time. Next, the input row data IRD is provided to the next row or next rows in sequence from R1 to Rn or in direction of the arrows from the upper side to the lower side of the display area of the display panel D as shown in FIG. 1. In other words, the light source, which is a single row or a plurality of rows of the digital pixels DP, scan sequentially between the row R1 and the row Rn, and the input row data IRD is continuously inputted to control the rows of digital pixels DP to display image.

Figure 2B:
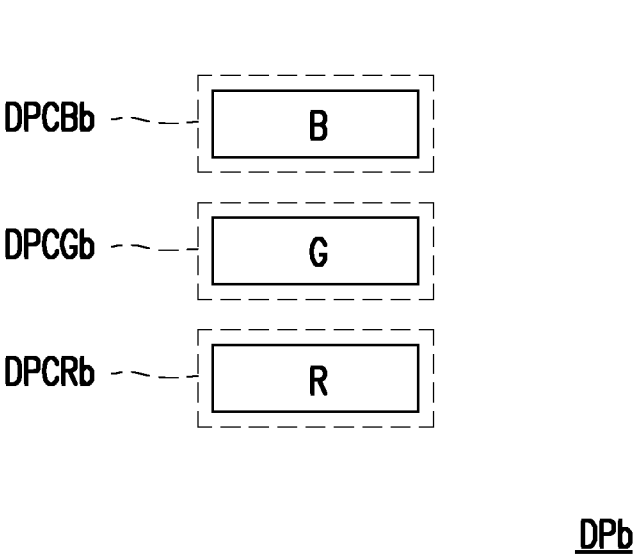
FIG. 2A and FIG. 2B are schematic views showing a digital pixel according to the embodiment in FIG. 1.
Figure 2A:
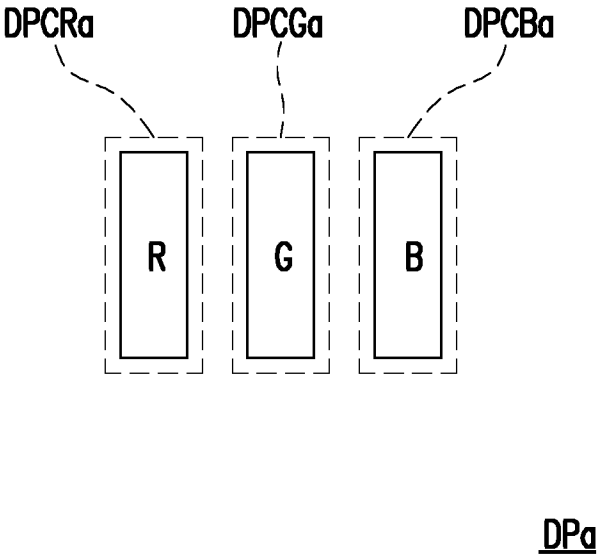

FIG. 2A and FIG. 2B are schematic views showing a digital pixel according to the embodiment in FIG. 1. As shown in FIG. 2A, a digital pixel DPa includes a red micro-LED R, a green micro-LED G, and a blue micro-LED B directly bonding on a silicon chip. To be more specific, each of the red micro-LED R, the green micro-LED G, and the blue micro-LED B is driven by one cell driver circuit (current driver) disposed below. The red micro-LED R and the corresponding cell driver circuit disposed under the red micro-LED R form a red digital pixel cell DPCRa. Similarly, the green micro-LED G and the corresponding cell driver circuit disposed under the green micro-LED G form a green digital pixel cell DPCGa, and the blue micro-LED B and the corresponding cell driver circuit disposed under the blue micro-LED B form a blue digital pixel cell DPCBa. In the present embodiment, the red digital pixel cell DPCRa, the green digital pixel cell DPCGa, and the blue digital pixel cell DPCBa are horizontally arranged, but the invention is not limited thereto.

A digital pixel DPb shown in FIG. 2B is similar to the digital pixel DPa shown in FIG. 2A. The difference is that a red digital pixel cell DPCRb, the green digital pixel cell DPCGb, and the blue digital pixel cell DPCBb are vertically arranged.

Figure 3:
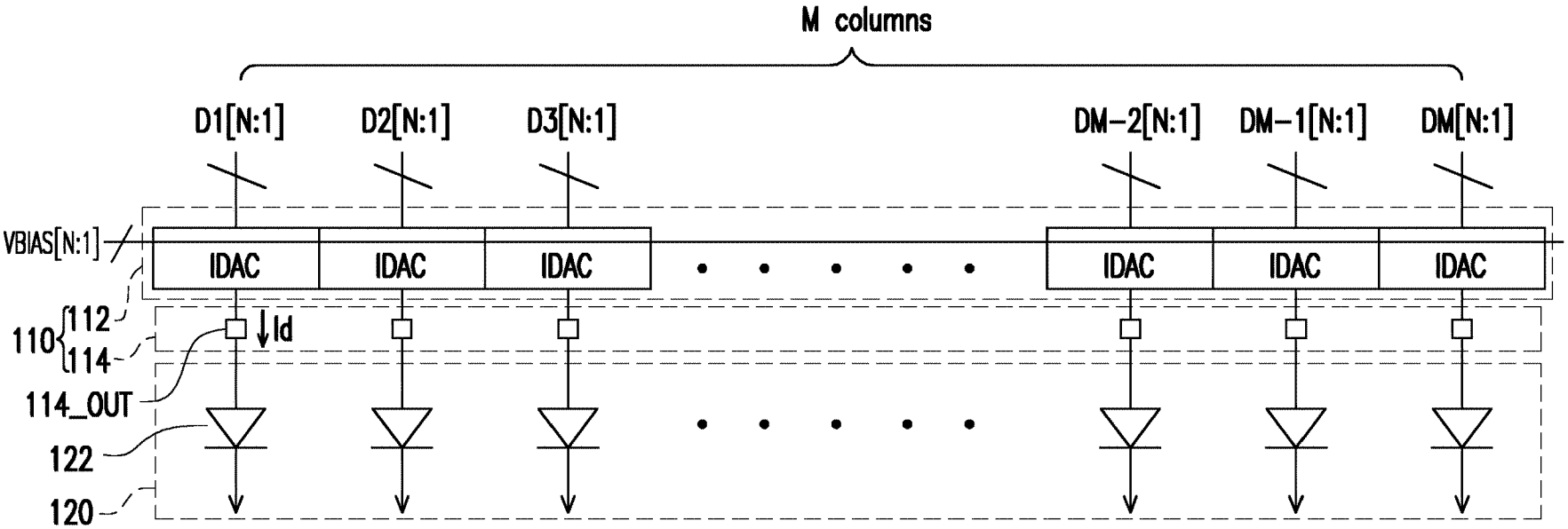
FIG. 3 is a schematic view showing an LED driving apparatus for driving an LED array according to an embodiment of the invention.

FIG. 3 is a schematic view showing an LED driving apparatus for driving an LED array according to an embodiment of the invention. Referring to FIG. 3, the LED driving apparatus 110 is configured to drive the LED array 120 of M columns, where M is an integer greater than zero. The LED array 120 includes a plurality of LEDs 122, forming a full display area or a partial display area of the display panel D. The LEDs 122 emit the same color light or different color lights. In FIG. 3, only one LED row of the LED array 120 is illustrated for example, but the invention is not limited thereto. In an embodiment, the LED array 120 may include a plurality of LED rows, and one or more LED driving apparatuses 110 are configured to drive the plurality of LED rows.

To be specific, the LED driving apparatus 110 includes a converter group 112 and an output terminal group 114. The output terminal group 114 is coupled to the LED array 120. The output terminal group 114 includes a plurality of output terminals 114_OUT. Each of the output terminals 114_OUT is coupled between a corresponding digital-to-analog converter IDAC and a corresponding LED 122 as illustrated in FIG. 3. The LEDs 122 coupled to the output terminal group 114 may be all LEDs in a row of the LED array 120 or a part of LEDs in the row of the LED array 120.

The converter group 112 includes a plurality of digital-to-analog converters IDAC. Each of the digital-to-analog converters IDAC is electrically coupled to a corresponding output terminal 114_OUT. Each of the digital-to-analog converters IDAC outputs a driving current Id according to respective N-bits pixel data to drive a corresponding LED 122, where N is an integer greater than zero. That is to say, the digital-to-analog converter IDAC is a current output digital-to-analog converter. The N-bits pixel data may be one of pixel data D1[N:1], D2[N:1], D3[N:1], . . . DM-2[N:1], DM-1[N:1] and DM[N:1]. The pixel data D1[N:1] indicates N-bits pixel data for driving an LED of the first column of the LED array 120, and the pixel data DM[N:1] indicates N-bits pixel data for driving an LED of the $M^{th}$ column of the LED array 120. Other pixel data D2[N:1], D3[N:1], . . . DM-2[N:1] and DM-1[N:1] can be deduced by analogy. In addition, the biasing voltage signals VBIAS[N:1] are inputted to each digital-to-analog converters IDAC to the driving currents Id.

Figure 4:
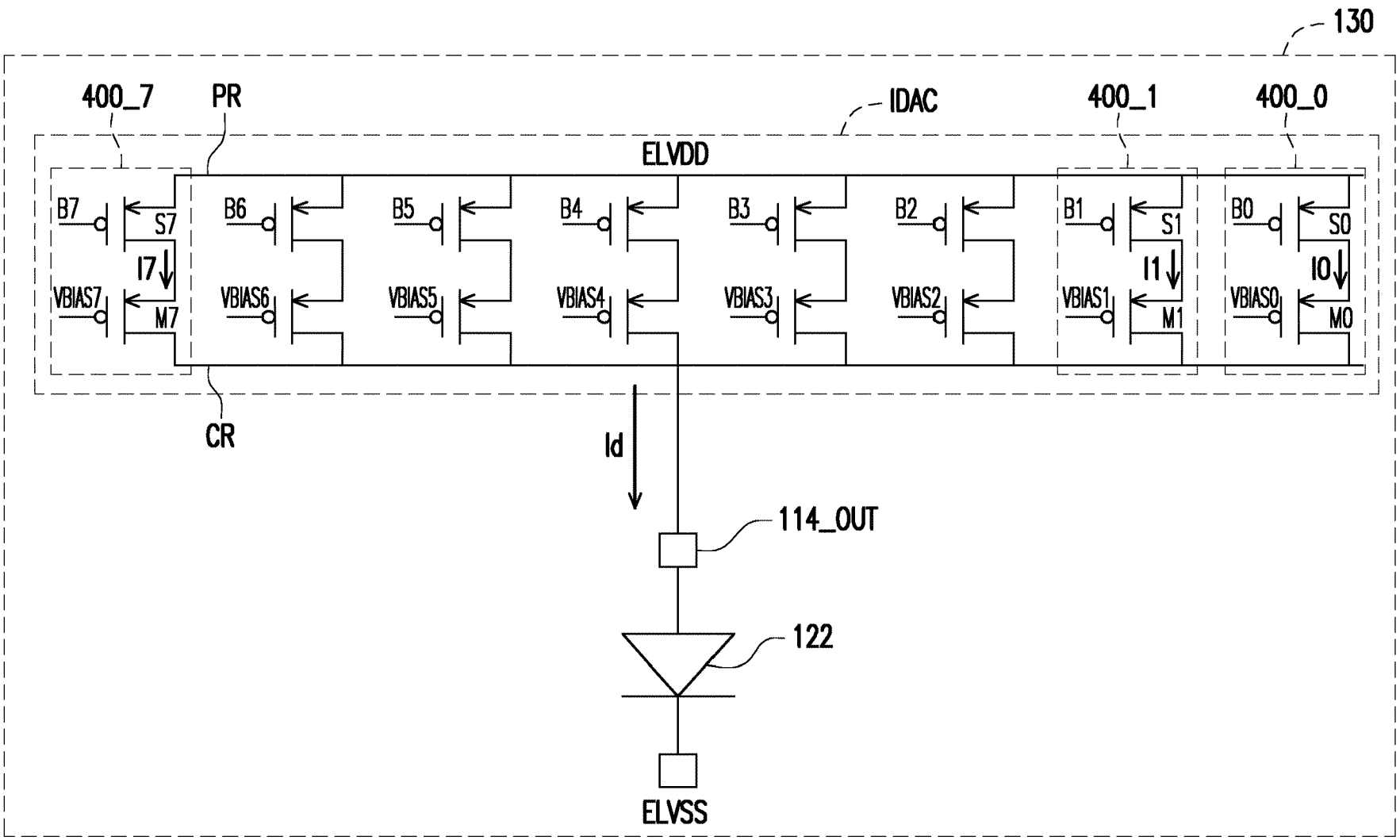
FIG. 4 is a schematic view showing a pixel cell according to an embodiment of the invention.

FIG. 4 is a schematic view showing a pixel cell according to an embodiment of the invention. Referring to FIG. 4, an example of a digital-to-analog converter IDAC of 8 bits is illustrated in FIG. 4. A pixel data Dj[N:1] (N=8) including bits B0~B7 are inputted to the digital-to-analog converter IDAC, where the pixel data Dj[N:1] indicates N-bits pixel data for driving the $j^{th}$ column of the LED array 120, and $1 \leq j \leq M$. In an embodiment, a plurality of pixel cells 130 as illustrated in FIG. 4 are form an LED array in a display panel.

The pixel cell 130 may be a pixel located the $j^{th}$ column of the LED array 120. The pixel cell 130 includes one digital-to-analog converter IDAC and one LED 122. The system voltages ELVDD and ELVSS are applied to the pixel cell 130 as operating voltages. The digital-to-analog converter IDAC outputs the driving current Id to drive the LED 122. The digital-to-analog converter IDAC includes a power rail PR, a common rail CR and N sub-driving current generating circuits 400_0, 400_1~400_7 coupled between the power rail PR and the common rail CR. In the present embodiment, N is equal to 8, but the number of the sub-driving current generating circuits does not intend to limit the invention. The sub-driving current generating circuits 400_0, 400_1~400_7 are coupled to the output terminal 114_OUT.

Each of the sub-driving current generating circuits 400_0, 400_1~400_7 is configured to generate a sub-driving current I0, I1~I7 having a current value corresponding to a bit order of a bit of the N-bits pixel data Dj[N:1]. For example, the sub-driving current generating circuit 400_0 receives the bit B0 of the N-bits pixel data Dj[N:1] and generates the sub-driving current I0. The sub-driving current I0 has a current value $2^0$I (=1I) corresponding to the bit order 1 of the bit B0. The sub-driving current I1 has a current value $2^1$I(=2I) corresponding to the bit order 2 of the bit B1. Similarly, the sub-driving current I7 has a current value $2^7$I (=128I) corresponding to the bit order 8 of the bit B7. The current values of other sub-driving currents can be deduced by analogy. That is to say, the sub-driving current I(i−1) has a current value $2^{(i-1)}$I corresponding to the bit order i of the bit B(i−1), where i is an integer greater than and equal to 1 and smaller than N, and I is a current step. In the present embodiment, N is equal to 8, but the number of the sub-driving current does not intend to limit the invention. In addition, the biasing voltages VBIAS0~VBIAS7 are inputted to drive the sub-driving current generating circuits 400_0, 400_1~400_7 to output the sub-driving currents I0, I1-I7.

In the present embodiment, each of the sub-driving current generating circuits 400_0, 400_1~400_7 includes a switching device and a current source device. For example, the sub-driving current generating circuit 400_0 includes a switching device S0 and a current source device M0. The first end of the switching device S0 is electrically coupled to the power rail PR. The current source device M0 is electrically coupled between the switching device S0 and the common rail CR. To be specific, the switching device S0 includes a first end, a second end and a control end. The first end of the switching device S0 is coupled to the power rail PR. The control end of the switching device S0 is controlled by the bit B0 of the N-bits pixel data Dj[N:1]. The current source device M0 includes a first end, a second end and a control end. The first end of the current source device M0 is coupled to the second end of the switching device S0. The second end of the current source device M0 is coupled to the common rail CR. The control end of the current source device M0 is controlled by the biasing voltage VBIAS0. The circuit structures of other sub-driving current generating circuits 400_1~400_7 can be deduced by analogy. The current source devices M0, M1~M7 may be current source transistors. The current source devices M0, M1~M7 are configured to generate the sub-driving currents I0, I1~I7 according to the biasing voltages VBIAS0~VBIAS7. The current source devices M0, M1~M7 are respectively controlled by the N bias voltages VBIAS0~VBIAS7 so as to output the N sub-driving currents I0, I1~I7 corresponding to different bit orders of the bits B0~B7, where N is equal to 8 in the present embodiment. For example, the current source device M0 is controlled by the bias voltage VBIAS0 and generates the sub-driving current I0, and the sub-driving current I0 has a current value $2^0$I (=I1) corresponding to the bit order 1 of the bit B0. The current source device M1 is controlled by the bias voltage VBIAS1 and generates the sub-driving current I1, and the sub-driving current I1 has a current value $2^1$I (=2I) corresponding to the bit order 2 of the bit B1. Similarly, the current source device M7 is controlled by the bias voltage VBIAS7 and generates the sub-driving current I7, and the sub-driving current I7 has a current value $2^7$I(=128I) corresponding to the bit order 8 of the bit B7. The current values of other sub-driving currents can be deduced by analogy. That is to say, an $i^{th}$ current source device is configured to provide a current having a value of $2^{(i-1)}$I, where i is an integer greater than and equal to 1 and smaller than N, I is a current step. In the present embodiment, N is equal to 8, but the number of the sub-driving current does not intend to limit the invention. The values of the biasing voltages VBIAS0~VBIAS7 may be the same or different, which depends on the design of the current source devices M0~M7. In one embodiment, the current source devices M0~M7 are configured to respectively include transistors of different sizes or transistors of different amounts, and the biasing voltages VBIAS0~VBIAS7 may be configured to be the same voltage (which means that the LED driving apparatus requires only one biasing voltage for controlling the plurality of digital-to-analog converters IDAC), so as to generate different sub-driving currents I0-I7. In another embodiment, the current source devices M0~M7 are configured to respectively include transistors of the same size or transistors of the same amount, the biasing voltages VBIAS0~VBIAS7 have to be configured to be different voltages (which means that the LED driving apparatus requires eight different biasing voltages for controlling the plurality of digital-to-analog converters IDAC), so as to generate different sub-driving currents I0-I7.

The switching devices S0, S1~S7 are configured to respectively output or not to output the sub-driving currents I0, I1-I7 to the common rail CR. For example, the switching devices S0, S1~S7 are turned on and output the sub-driving currents I0, I1~I7 to the common rail CR according to the bits B0, B1~B7 of the N-bits pixel data Dj[N:1]. The switching devices S0, S1~S7 are turned off and not output the sub-driving currents I0, I1~I7 to the common rail CR according to the bits B0, B1~B7 of the N-bits pixel data Dj[N:1].

The driving current Id is generated by summing up N sub-driving currents I0~I7, where N=8 in the present embodiment. The driving current Id is calculated by the following equation:

$$Id=2^{(N-1)}I\times B(N-1)+\ldots+2^{(i-1)}I\times B(i-1)+\ldots+2^1I\times B1+2^0I\times B0$$

where the bits B0, B1, B(i−1), B(N−1) are the N-bits pixel data Dj[N:1], i is an integer greater than and equal to 1 and smaller than N, I is a current step, and N=8 in the present embodiment. Therefore, the digital-to-analog converter IDAC outputs the driving current Id according to the N-bits pixel data to drive the LED, and the driving current Id is generated by summing up the sub-driving currents.

In the present embodiment, the switching device S0, for example, has a low operating voltage, and the current source device M0, for example, has a middle operating voltage.

When the LED 122 is turned off or in a disable state, the voltage of the anode of the LED 122 is approximately equal to a voltage ELVSS. Since the current source device is directly and electrically connected to the anode of the LED 122, the current source device is a middle voltage (MV) device when concerning the stress of the current source device. In other words, the current source device is a middle voltage device to withstand the voltage stress from the anode.

Since the switching device S0 is electrically coupled between the power rail PR and the current source device M0, the switching device S0 is near a voltage ELVDD of the power rail PR. Therefore, when the switching device S0 is turned on (in enable state) or is turned off (in disable state), the drain, the source, the gate, and the bulk of the switching device S0 are not stressed because of overvoltage. Consequently, it is possible that the switching device S0 is a low voltage (LV) device.

As a result, in the present embodiment, the switching device S0 can be a LV device and the current source device M0 can be a MV device. In addition, the switching device S0 is controlled to be turned on or turned off by the high and low levels of the bit B0, and the current source device M0 is controlled by the bias voltage VBIAS0. Since the switching device S0 is a LV device, it is possible that the bit B0 is a LV lever control signal. It should be noted here, the bit B0 and the bias voltage VBIAS0 may be applied at the same time or at different times, the invention is not limited thereto.

Normally, the LV device has a lower threshold voltage Vt, a lower turn-on resistance, and a smaller size compared to the MV device. Therefore, in the present embodiment, the dynamic power required in turning on and turning off the switching device S0, which is a LV device, can be reduced. In addition, the noise coupled back from the switching device S0, when switching (turning on and turning off), to the bias voltage VBIAS0, can be also greatly reduced.

In the present embodiment, the switching device S0 is a switching transistor, and the current source device M0 is a current source transistor. The LED 122 may be a red, green, or blue micro-LED. However, the invention is not limited thereto.

Figure 5:
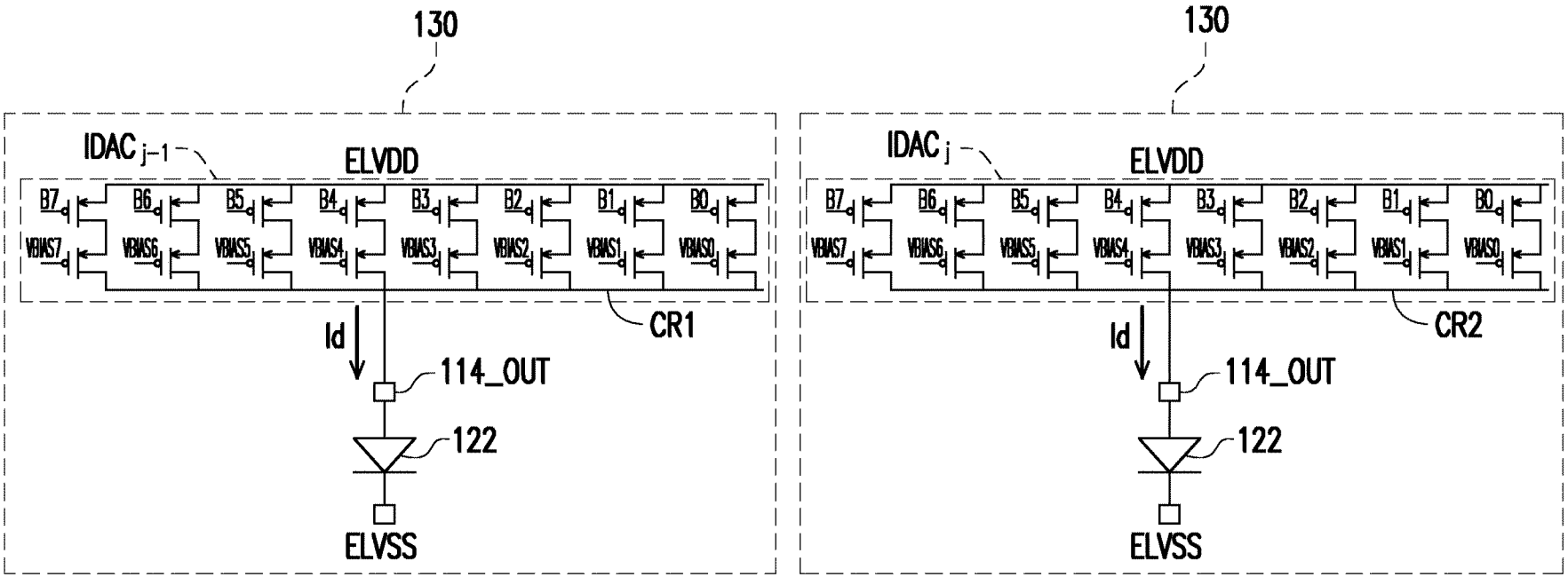
FIG. 5 illustrates a schematic diagram of two pixel cells according to an embodiment of the invention.

FIG. 5 illustrates a schematic diagram of two pixel cells according to an embodiment of the invention. Referring to FIG. 5, the two pixel cells 130 are located in neighboring columns such as $(j-1)^{th}$ and $j^{th}$ columns of the LED array of a display panel. The common rail CR1 of the digital-to-analog converter $IDAC_{j-1}$ and the common rail CR2 of the digital-to-analog converter $IDAC_j$ are separate. In the embodiments of the invention, the common rails of the plurality of digital-to-analog converters are separate.

Figure 6:
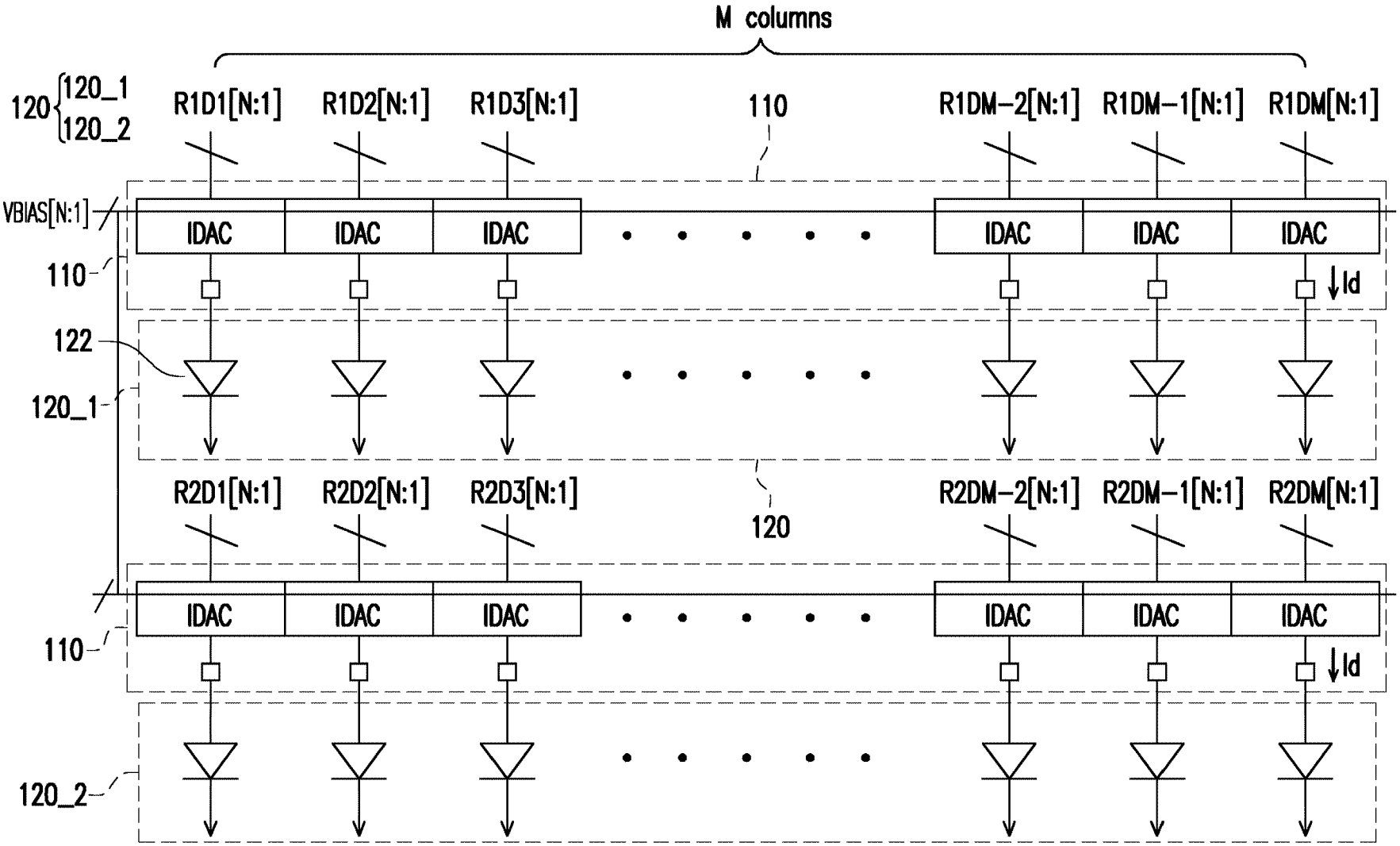
FIG. 6 is a schematic view showing an LED driving apparatus for driving an LED array according to another embodiment of the invention.

FIG. 6 is a schematic view showing an LED driving apparatus for driving an LED array according to another embodiment of the invention. Referring to FIG. 6, the LED driving apparatus 110 is configured to drive the LED array 120 of M columns, where M is an integer greater than zero. The LED array 120 includes at least LED rows 120_1 and 120_2. The digital-to-analog converter IDAC of the LED driving apparatus 110 are arranged for driving the LED rows 120_1 and 120_2, respectively. The biasing voltage signal VBIAS[N:1] is inputted to the digital-to-analog converter IDAC of the two rows. Each of the digital-to-analog converters IDAC of the first row outputs the driving current Id according to respective N-bits pixel data R1D1[N:1], R1D2[N:1], R1D3[N:1], . . . R1DM-2[N:1], R1DM-1[N:1] and R1DM[N:1] to drive a corresponding LED 122.

Each of the digital-to-analog converters IDAC of the second row outputs the driving current Id according to respective N-bits pixel data R2D1[N:1], R2D2[N:1], R2D3[N:1], . . . R2DM-2[N:1], R2DM-1[N:1] and R2DM[N:1] to drive a corresponding LED 122.

Figure 7:
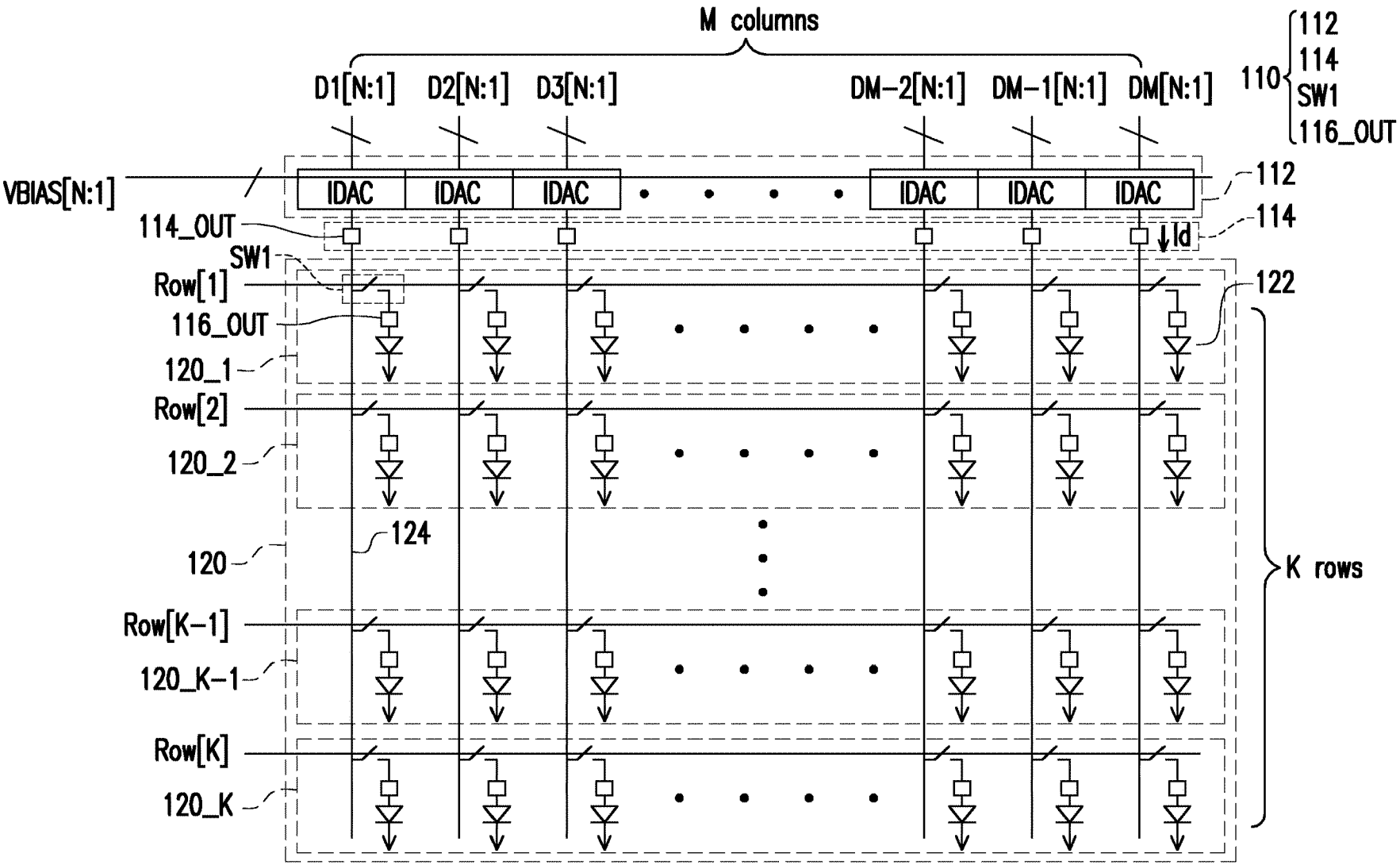
FIG. 7 is a schematic view showing an LED driving apparatus for driving an LED array according to another embodiment of the invention.

FIG. 7 is a schematic view showing an LED driving apparatus for driving an LED array according to another embodiment of the invention. Referring to FIG. 7, the LED array 120 of M columns and K rows is available, which means M×K pixel resolution display is achieved, where M and K are integers greater than zero. The LEDs 122 in the same column share the same digital-to-analog converter IDAC and the same common line 124.

To be specific, the LED driving apparatus 110 includes a plurality of switches SW1 and a plurality of output terminals 116_OUT. Each of switches SW1 is configured to electrically connect an LED 122 of the LED array 120 through a corresponding output terminal 116_OUT to a corresponding digital-to-analog converter IDAC of the converter group 112. The LED driving apparatus 110 of FIG. 7 is physically coupled to the LED array 120 by the plurality of output terminals 116_OUT. Anodes of the LEDs 122 in the same column are separated by switches SW1 from the common current driving line 124.

In the present embodiment, each time, only one of row emission control lines Row[1]~Row[K] can be activated and a corresponding row data is updated. As a result, each of the digital-to-analog converters IDAC of the converter group 112 time-divisionally outputs the driving current Id to sequentially drive a plurality of LEDs 122 in a column of the LED array 120. That is to say, for the LEDs 122 of the same column, the digital-to-analog converter IDAC time-divisionally outputs the driving current Id to the LED column, and the LEDs 122 of the same column are sequentially driven. For the LEDs 122 of the same row, the digital-to-analog converters IDAC output the driving currents Id to the LED row at the same time, and the LEDs 122 of the same row are driven at the same time.

Figure 8:
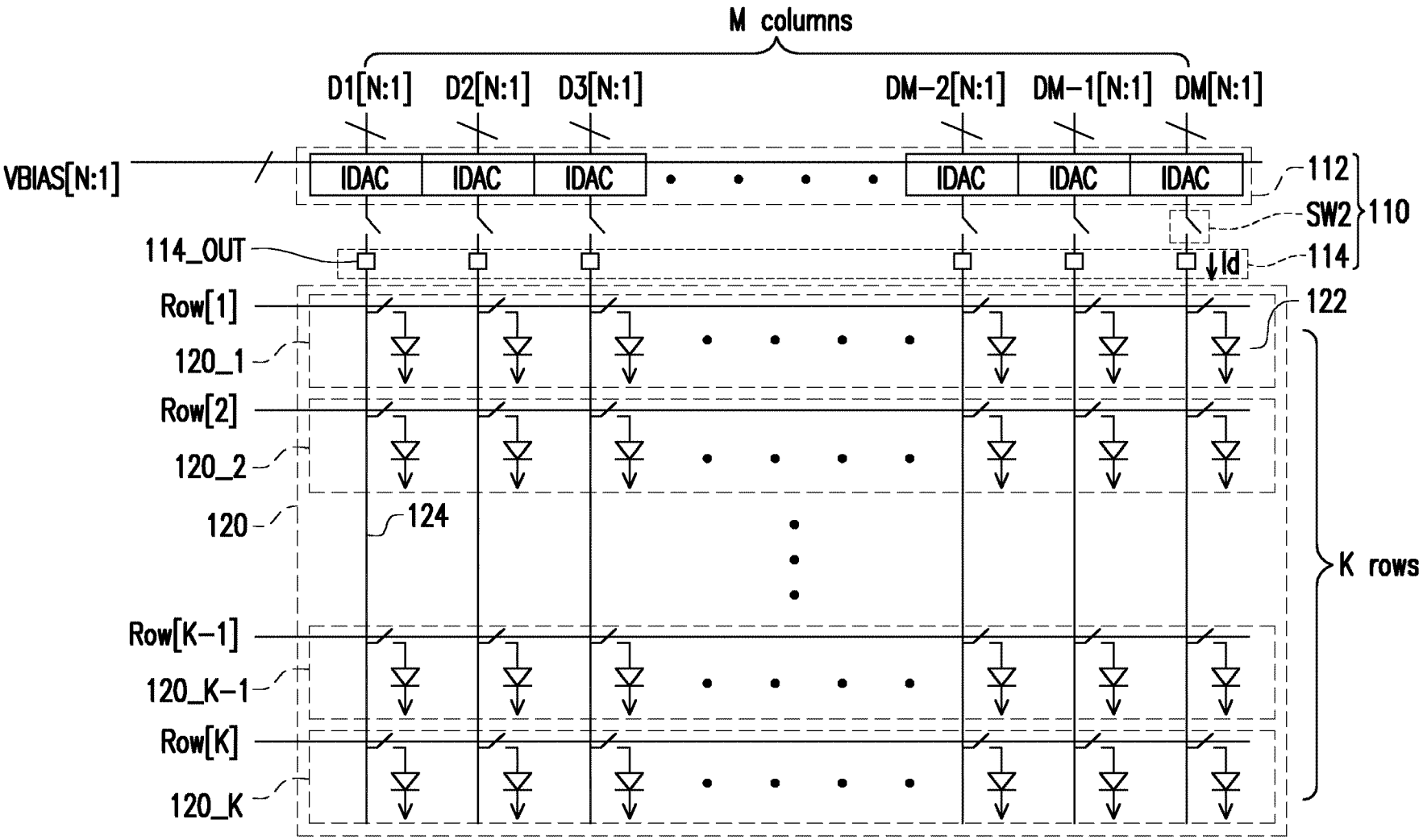
FIG. 8 is a schematic view showing an LED driving apparatus for driving an LED array according to another embodiment of the invention.
Figure 9:
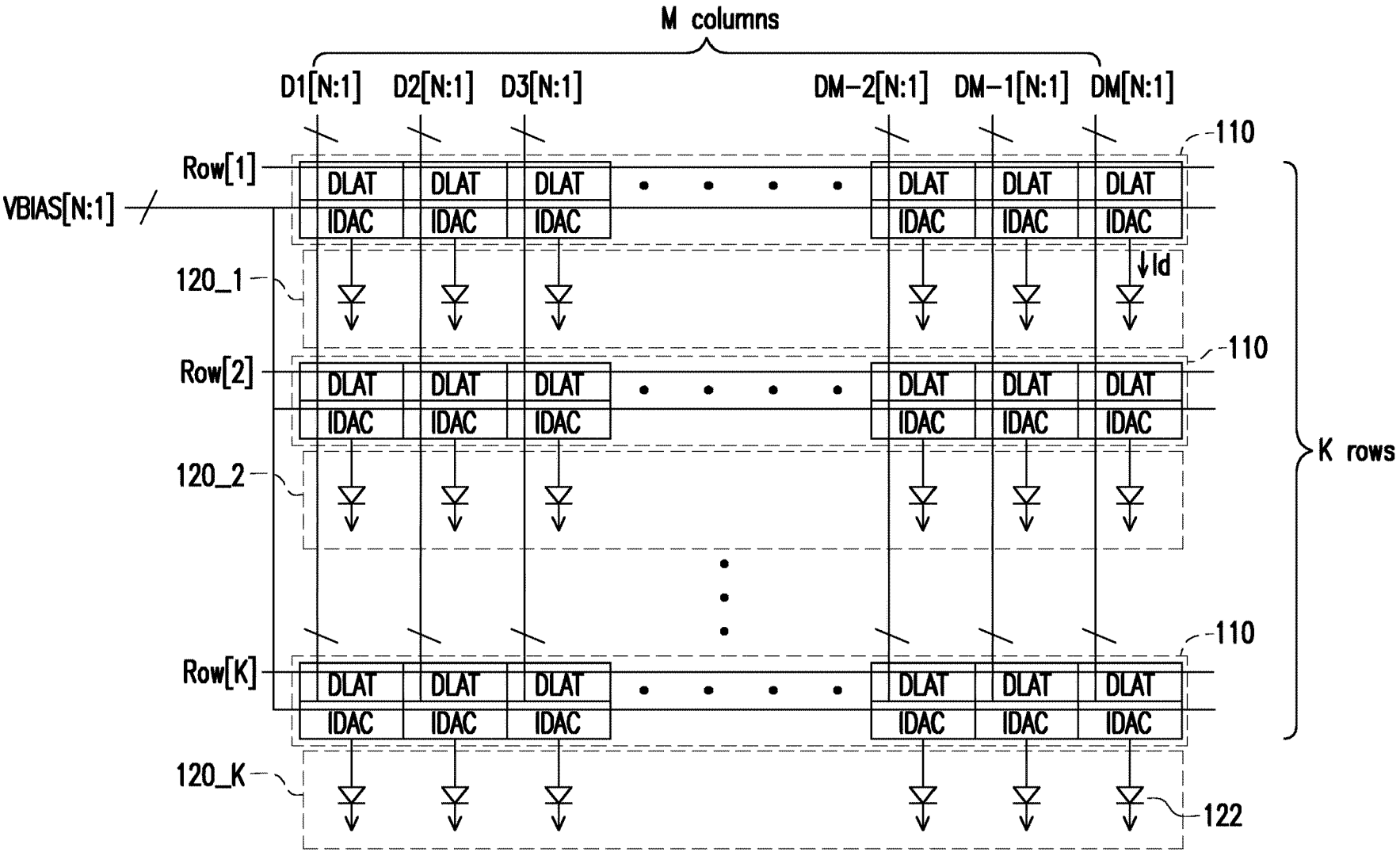
FIG. 9 is a schematic view showing an LED driving apparatus for driving an LED array according to another embodiment of the invention.

FIG. 8 is a schematic view showing an LED driving apparatus for driving an LED array according to another embodiment of the invention. Referring to FIG. 8, the main differences between the LED driving apparatus 110 depicted in FIG. 7 and the LED driving apparatus 110 depicted in FIG. 8 lies in that the switches SW1 are implemented in the display panel and coupled to the LED array, not in the LED driving apparatus 110, and the LED driving apparatus 110 includes a plurality of switches SW2, wherein each of the switches SW2 is configured to electrically connect an output terminal 114_OUT of the output terminal group 114 to a corresponding digital-to-analog converter IDAC of the converter group 112. The LED driving apparatus 110 of FIG. 8 does not include the output terminals 116_OUT as depicted in FIG. 7, and is physically coupled to the LED array 120 by the output terminals 114_OUT instead. In the embodiment of FIG. 8, each time, only one of row emission control lines Row[1]~Row[K] can be activated and a corresponding row data is updated. As a result, each of the digital-to-analog converters IDAC of the converter group 112 time-divisionally outputs the driving current Id to sequentially drive a plurality of LEDs 122 in a column of the LED array 120. The way of sequentially driving each LED row is similar to the embodiment of FIG. 7. FIG. 9 is a schematic view showing an LED driving apparatus for driving an LED array according to another embodiment of the invention. Referring to FIG. 9, the LED driving apparatus 110 of the present embodiment is similar to the LED driving apparatus 110 depicted in FIG. 7, and the main difference therebetween lies in that the LED driving apparatus 110 of the present embodiment further includes a plurality of data latch circuits DLAT.

The data latch circuits DLAT are respectively coupled to the digital-to-analog converters IDAC. Each of the data latch circuits DLAT is configured to store the N-bits pixel data D1[N:1], D2[N:1], D3[N:1], . . . DM-2[N:1], DM-1[N:1] and DM[N:1] and control data writing of a corresponding digital-to-analog converter IDAC. In the present embodiment, the row emission control lines Row[1]~Row[K] does not need to be scanned sequentially or another different row scan timing scheme and can be activated at the same time. In other words, M columns and K rows light source of full display area can be lightened simultaneously.

In summary, in the embodiments of the invention, the current output digital-to-analog converter is configured to drive the LED directly without converting voltage into current. Due to current-driving scheme, the LED driving apparatus is capable of reducing the requirement that time to reach the steady state must be shorter than the minimum time unit, such that the display quality of the LED array driven by the LED driving apparatus is good. In addition, snice the design of the LED driving apparatus for each LED row is the same, the number of the LED driving apparatus can be easily increased for more LED rows, and the control of the LED driving apparatus is also easy.

It will be apparent to those skilled in the art that various modifications and variations can be made to the disclosed embodiments without departing from the scope or spirit of the invention. In view of the foregoing, it is intended that the invention covers modifications and variations provided that they fall within the scope of the following claims and their equivalents.

What is claimed is:

1. A light emitting diode (LED) driving apparatus for driving an LED array, comprising:

an output terminal group comprising a plurality of output terminals and configured to be coupled to a plurality of LEDs in a row of an LED array; and a converter group comprising a plurality of digital-to-analog converters, wherein each of the digital-to-analog converters is electrically coupled to a corresponding output terminal of the output terminal group and is configured to output a driving current according to n-bits pixel data to drive a corresponding one of the LEDs, where n is an integer greater than zero, wherein each of digital-to-analog converters comprises:

n sub-driving current generating circuits, coupled to the corresponding output terminal of the output terminal group, wherein each of the n sub-driving current generating circuits is configured to generate a sub-driving current having a current value corresponding to a bit order of a bit of the n-bits pixel data, and the driving current is generated by summing up n sub-driving currents.

2. The LED driving apparatus as recited in claim 1, wherein each of the digital-to-analog converters further comprises:

a power rail; and a common rail, coupled to a corresponding output terminal of the output terminal group, wherein the n sub-driving current generating circuits are coupled between the power rail and the common rail, and the common rails of the plurality of digital-to-analog converters are separate.

3. The LED driving apparatus as recited in claim 2, wherein each of the sub-driving current generating circuits comprises:

a switching device, electrically coupled to the power rail; and a current source device, electrically coupled between the switching device and the common rail and configured to generate the sub-driving current.

4. The LED driving apparatus as recited in claim 3, wherein the current source device is a current source transistor, and the current source devices of the digital-to-analog converter are respectively controlled by n bias voltages so as to output the n sub-driving currents corresponding to different bit orders.

5. The LED driving apparatus as recited in claim 3, wherein an $i^{th}$ current source device is configured to provide a current having a value of $2^{(i-1)}I$, and wherein i is an integer greater than and equal to 1 and smaller than n, I is a current step.

6. The LED driving apparatus as recited in claim 3, wherein the switching devices is configured to output or not to output the sub-driving current to the common rail.

7. The LED driving apparatus as recited in claim 3, wherein each of the digital-to-analog converters of the converter group is configured to time-divisionally output a plurality of driving currents to sequentially drive a plurality of LEDs in a column of the LED array.

8. The LED driving apparatus as recited in claim 7, further comprising:

a plurality of switches, wherein each of the plurality of switches is configured to electrically connect an LED of the LED array to a corresponding digital-to-analog converter of the converter group.

9. The LED driving apparatus as recited in claim 7, wherein each output terminal of the output terminal group is configured to be coupled through a common line to a plurality of first switches which are respectively coupled to a plurality of LEDs in a column of the LED array, and wherein the plurality of first switches are separate from the LED driving apparatus.

10. The LED driving apparatus as recited in claim 9, further comprising:

a plurality of second switches, wherein each of the plurality of second switches is configured to electrically connect an output terminal of the output terminal group to a corresponding digital-to-analog converter of the converter group.

11. The LED driving apparatus as recited in claim 1, further comprising:

a plurality of data latch circuits respectively coupled to the plurality of digital-to-analog converters of the converter group, wherein each of the plurality of data latch circuits is configured to store the n-bits pixel data for controlling a corresponding digital-to-analog converter of the converter group.

12. The LED driving apparatus as recited in claim 3, wherein the switching device has a low operating voltage, and the current source device has a middle operating voltage.

* * * * *